United States Patent [19]

Bauer et al.

[11] 4,037,317

[45] July 26, 1977

[54] METHOD OF MAKING FLUID OPERATED ELECTRICAL SWITCH CONSTRUCTION

[75] Inventors: Werner R. Bauer, Radnor, Pa.; Roger P. Sepso, Stratford, Conn.

[73] Assignee: Robertshaw Controls Company, Richmond, Va.

[21] Appl. No.: 706,069

[22] Filed: July 16, 1976

Related U.S. Application Data

[62] Division of Ser. No. 428,877, Dec. 27, 1973, Pat. No. 3,984,649.

[51] Int. Cl.[2] ..... H01H 11/00

[52] U.S. Cl. ..... 29/622; 200/82 A; 200/83 S

[58] Field of Search ..... 29/622, 628; 200/82 A, 200/83 R, 83 P, 83 S, 83 Y

[56] References Cited

U.S. PATENT DOCUMENTS

| | | | |
|---|---|---|---|
| 2,716,395 | 8/1955 | Pettigrew et al. | 60/376 |
| 2,807,686 | 9/1957 | Clendenin | 200/83 |
| 3,133,171 | 5/1964 | Griffith | 200/83 |
| 3,444,341 | 5/1969 | Mighton | 200/82 A |

*Primary Examiner*—Victor A. DiPalma
*Attorney, Agent, or Firm*—Candor, Candor & Tassone

[57] ABSTRACT

A fluid operated electrical switch construction having a first housing provided with an electrical switch therein and a second housing having an expandible and contractible fluid operated power element therein, the housings being secured together in a predetermined assembled relationship so that a motion transmitting arrangement is disposed in both of the housings and extends between the power element and the switch to transmit movement of the element to the switch to operate the same. The motion transmitting arrangement has a length adjustment unit therein that is adapted to be adjusted by first causing relative movement between the housings while the housings are assembled together but before the same are secured together so that once the adjustment unit has been adjusted to provide the proper length, the housings are secured together in such assembled relation.

11 Claims, 8 Drawing Figures

METHOD OF MAKING FLUID OPERATED ELECTRICAL SWITCH CONSTRUCTION

This application is a divisional patent application of its co-pending parent patent application, Ser. No. 428,877, filed Dec. 27, 1973, now U.S. Pat. No. 3,984,649.

This invention relates to an improved fluid operated electrical switch construction and to a method of making the same or the like.

It is well known that fluid operated electrical switch constructions have been provided wherein each includes a housing arrangement having a electrical switch therein and an expandible and contractible fluid operated power element therein operatively interconnected to the electrical switch by motion transmitting means that transmits movement of the element to the switch to operate the same.

It is also well known that such fluid operated electrical switch constructions each has means for calibrating the same so that the electrical switch construction will be tripped when a certain fluid condition exists in the power element and will be reset when another fluid condition exists in the power element.

Accordingly, it is a feature of this invention to provide a fluid operated electrical switch construction of the above type wherein improved means are provided for effecting the adjustment of the motion transmitting means between the power element and the electrical switch.

Another feature of this invention is to provide an improved method of making such an electrical switch construction or the like.

In particular, one embodiment of this invention provides a fluid operated electrical switch construction having a first housing provided with an electrical switch therein. A second housing has a expandible and contractible fluid operated power element therein. The two housings are secured together in a predetermined assembled relationship. Motion transmitting means is disposed in the housings between the power element and the switch to transmit movement of the power element to the switch to operate the same. The motion transmitting means has length adjustment means therein that is adapted to be adjusted by causing relative movement between the housings while the housings are assembled together but before the same are secured together whereby once the length adjustment means has been adjusted to the desired degree, the housings are secured together in that particular relation to complete the electrical switch construction.

Accordingly, it is an object of this invention to provide an improved fluid operated electrical switch construction having one or more of the novel features set forth above or hereinafter shown or described.

Another object of this invention is to provide an improved method of making such a switch construction or the like, the method of this invention having one or more of the novel features set forth above or hereinafter shown or described.

Other objects, uses and advantages of this invention are apparent from a reading of this description, which proceeds with reference to the accompanying drawings forming a part thereof and wherein.

Figure 1:
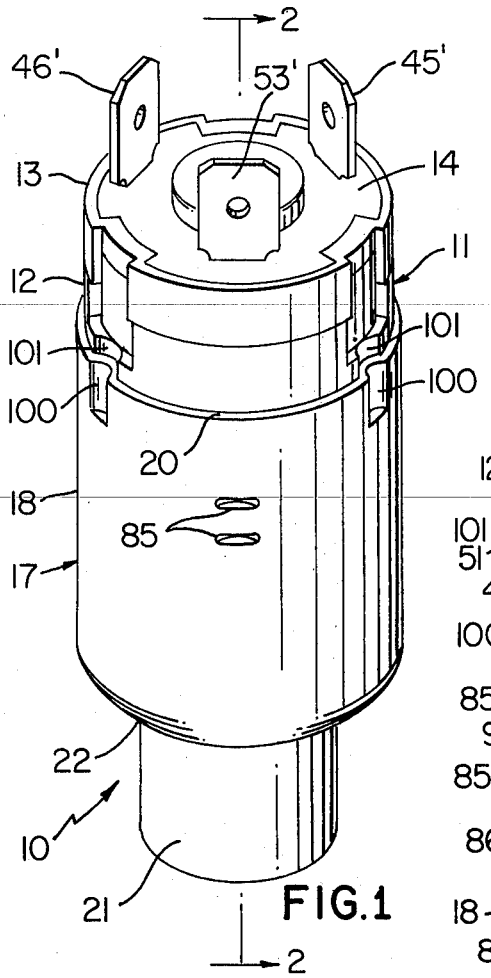
FIG. 1 is a perspective view of the improved electrical switch construction of this invention.

While the various features of this invention are hereinafter described and illustrated as being particularly adapted to provide a fluid operated electrical switch construction, it is to be understood that the various features of this invention can be utilized singly or in any combination thereof to provide other control structures as desired.

Therefore, this invention is not to be limited to only the embodiment illustrated in the drawings, because the drawings are merely utilized to illustrate one of the wide variety of uses of this invention.

Figure 2:
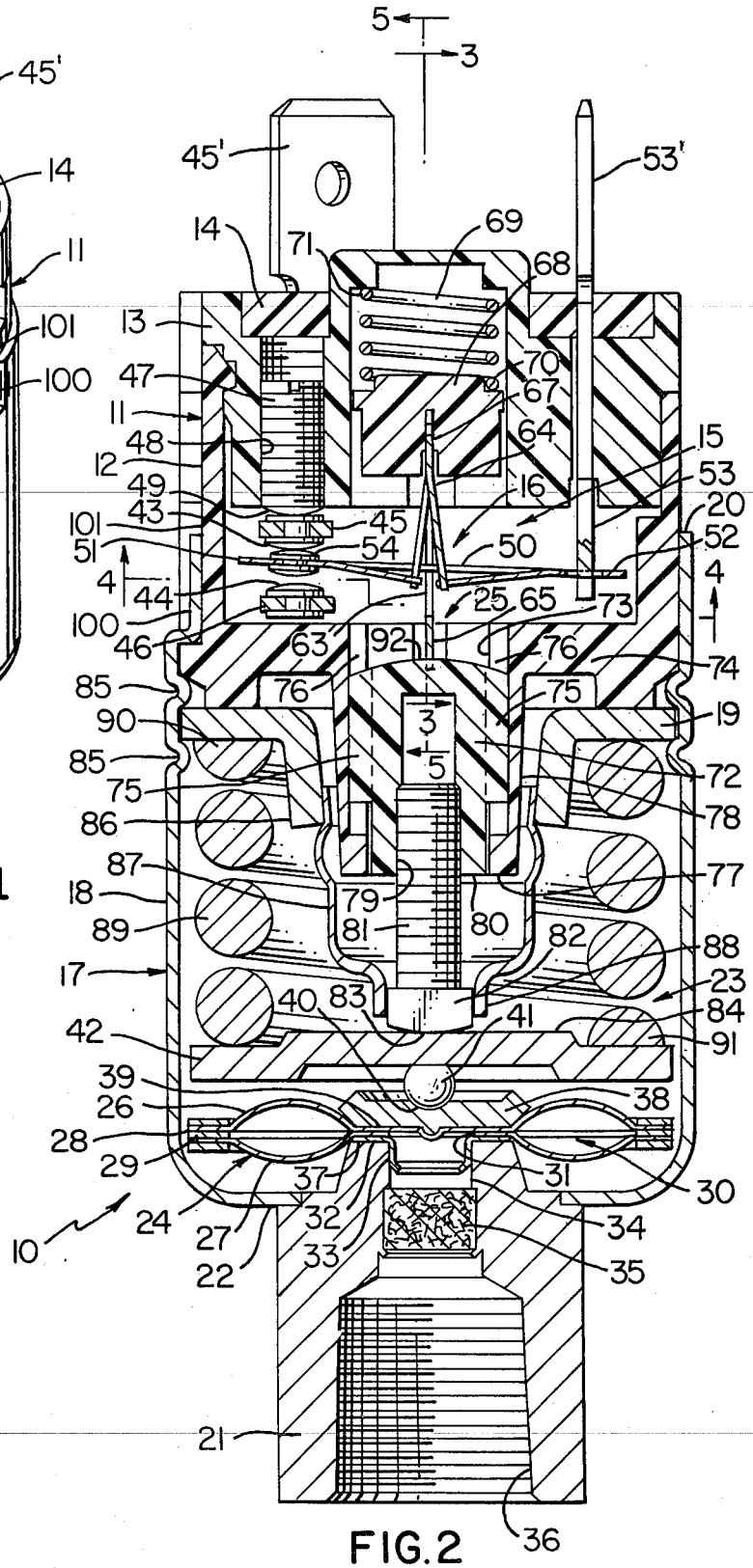
FIG. 2 is a enlarged cross-sectional view taken on line 2—2 of FIG. 1.

Referring now to FIGS. 1 and 2, improved fluid operated electrical switch construction of this invention is generally indicated by the reference numeral 10 and comprises a first housing means generally indicated by the reference numeral 11 and formed from a plurality of housing parts 12 and 13 suitably secured together and sealed by a suitable potting compound 14 to define a chamber 15 therein that contains an electrical switch that is generally indicated by the reference numeral 16 and hereinafter described.

The fluid operated electrical switch construction also includes a second housing that is generally indicated by the reference numeral 17 and comprises a cup-shaped casing 18 cooperating with an annular spring adjusting ring 19 adjacent its open end 20 and with a fitting 21 at its closed end 22 to define a chamber 23 therein that contains an expandible and contractible fluid operated power element that is generally indicated by the reference numeral 24 and hereinafter described.

The housing means 11 and 17 are secured together in an adjusted relationship as hereinafter described so that a motion transmitting arrangement or means that is generally indicated by the reference numeral 25 extends between the two housing 11 and 17 and operatively interconnects the power element 24 to the electrical switch 16 to operate the same in a manner hereinafter described.

The power element 24 comprises a pair of fluted diaphragm members 26 and 27 formed of metallic material and being suitably secured together at their outer annular flat peripheries 28 by an interposed annular washer-like member 29 so that a chamber 30 is formed in the element 24 inboard of the washer-like member 29.

The lower diaphragm member 27 has an opening 31 passing centrally through the flat inner periphery and around which is secured an eyelet-like member 32 that has tubular portion 33 thereof adapted to be disposed in a stepped bore 34 passing through the fitting 21 so as to fluidly interconnect the chamber 30 of the power element 24 to the stepped bore 34 of the fitting 21. The bore 34 of the fitting 21 has a suitable filter 35 disposed therein and is internally threaded at 36 to interconnect to a fluid pressure generating means (not shown) for a purpose hereinafter described to control the expansion and contraction of the power element 24 whereby the upper diaphragm member 26 is adapted to move upwardly and downwardly relative to a shoulder 37 of the fitting 21 against which the lower diaphragm member 27 is positioned by the eyelet 32 when the eyelet 32 is fully received in the stepped bore 34 as illustrated in FIG. 2.

A diaphragm button 38 is carried by the inner central peripheral portion 39 of the upper diaphragm member 26 and has a central concave recess 40 formed therein for receiving a ball 41 carried by a plate member 42 and forming part of the motion transmitting means 25 that is hereinafter described.

The details of the power element 24 and the method of making the same form the subject matter of a patent application being filed concurrently with this patent application, Ser. No. 428,875, filed Dec. 27, 1973, now abandoned. Thus, see such copending patent application if further details of the power element 24 and the method of making the same are desired.

The electrical switch 16 includes a pair of fixed contacts 43 and 44 disposed in spaced-apart relation relative to each other and being repectively carried by terminal arms 45 and 46 fixed to the housing means 11, the terminal arm 45 having a natural bias toward the housing part 13 and being movable away from the same by a self-tapping or thread making threaded calibration adjustment member 47 being threadedly disposed in a bore 48 formed through the housing part 13 so that the lower end 49 of the adjustment member 47 can bear against the terminal part 45 to move the same toward the terminal part 46 as the threaded member 47 is threaded downwardly in FIG. 2 or to permit the terminal part 45 to move upwardly relative to the terminal part 46 as the threaded member 47 is threaded upwardly in the bore 48 for a purpose hereinafter described.

The electrical switch 16 includes a snap switch blade 50 that has opposed ends 51 and 52 and is formed of conductive material, the end 52 being fixed to a third terminal arm 53 carried by the housing means 11 while the end 51 of the blade 50 is movable relative to the housing means 11 and carries contact means 54 thereon for respectively cooperating with the fixed contact means 43 and 44 in a manner hereinafter described.

Figure 3:
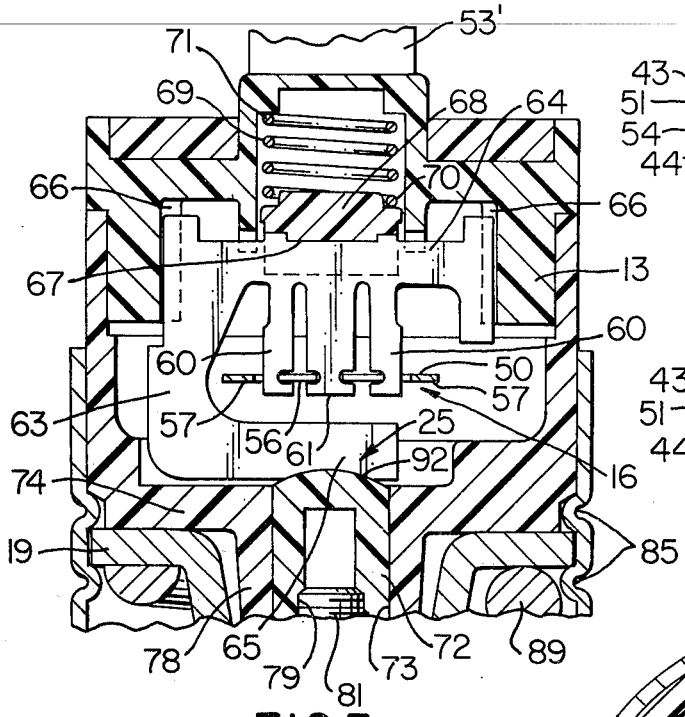
FIG. 3 is a fragmentary, cross-sectional view taken on line 3—3 of FIG. 2.
Figure 4:
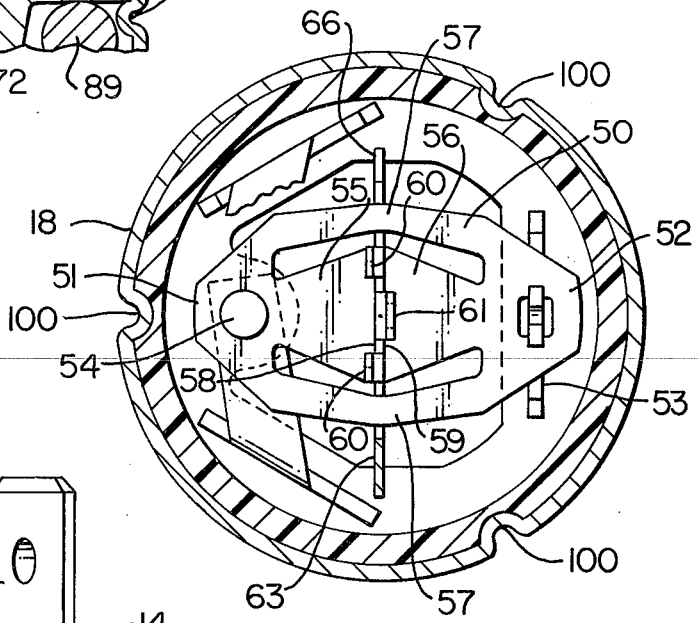
FIG. 4 is a cross-sectional view taken on line 4—4 of FIG. 2.
Figure 5:
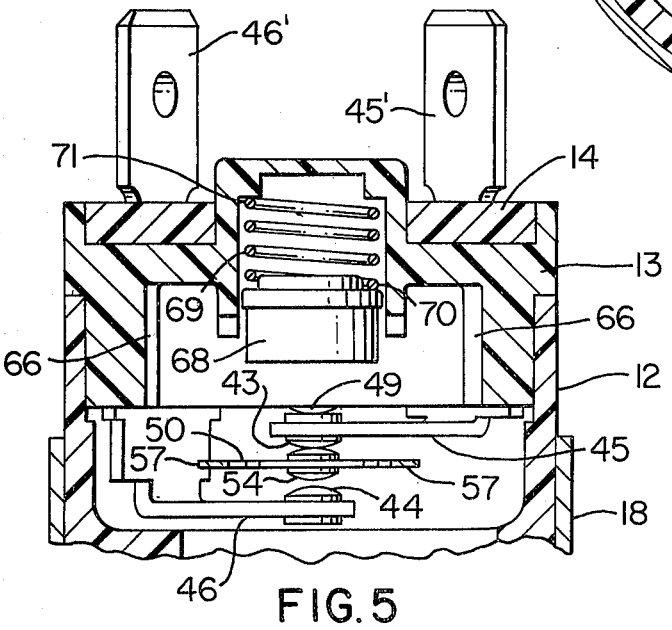
FIG. 5 is a fragmentary, cross-sectional view taken on line 5—5 of FIG. 2.
Figure 6:
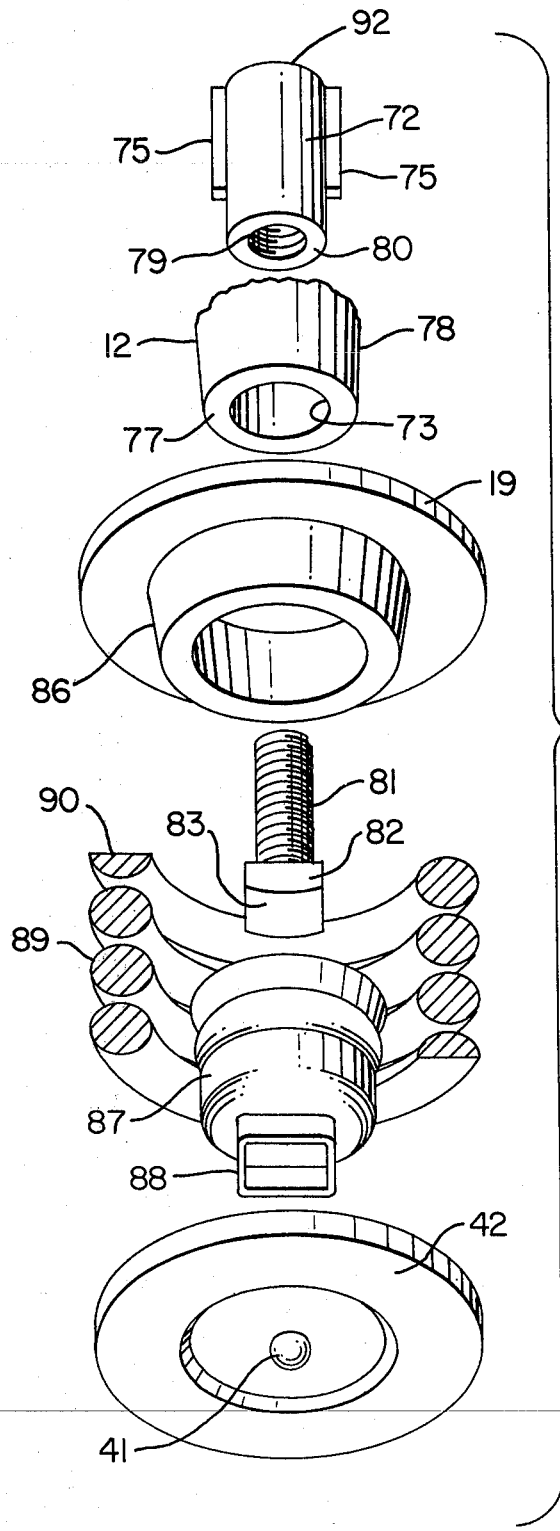
FIG. 6 is an exploded perspective view of the motion transmitting means of the switch construction of FIG. 2.

As illustrated in FIGS. 3 and 4, the switch blade 50 has a pair of tongues 55 and 56 carved therefrom and respectively extending from the opposed ends 51 and 52 of the blade 50 and being disposed inboard of a pair of side tension members 57 of the blade 50.

The tongues 55 and 56 are respectively interconnected at their inner ends 58 and 59 to leg means 60 and 61 of a C-shaped actuator or fork 63 having opposed ends 64 and 65 disposed in aligned relation and interconnected together by an arcuate portion as illustrated in FIG. 3 whereby the legs 60 and 61 extend from the end 64 of the actuator 63 to interconnect the end 64 of the actuator 63 to the tongues 55 and 56 of the snap blade 50.

Figure 2A:
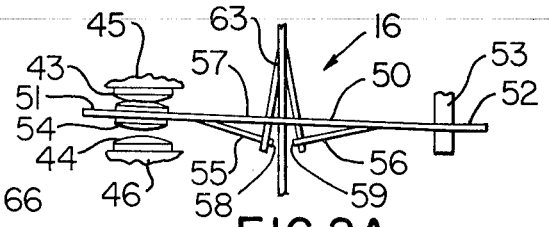
FIG. 2A is a schematic view of the electrical switch of the switch construction of FIG. 2.

The end 64 of the C-shaped actuator 63 is disposed in guiding slot mean 66 of the housing part 13 and is also received in a slot 67 of a spring retainer 68 being urged downwardly against the end 64 of the actuator 63 in FIG. 2 by a compression spring 69 having one end 70 bearing against the spring retainer 68 and the other end 71 thereof bearing against the housing part 13 whereby the force of the spring 69 tends to move the actuator 63 downwardly and cause the tongues 55 and 56 of the snap blade 50 to pass or toggle over center of the tension members 57 to the position illustrated schematically in FIG. 2A so that the end 51 of the blade 50 is snapped upwardly and has its contact 54 held in urging contact with the upper fixed contact 43 to complete a circuit from the terminal arm 53 carrying the end 52 of the blade 50 to the terminal arm 45 through the conductive switch blade 50.

Figure 2B:
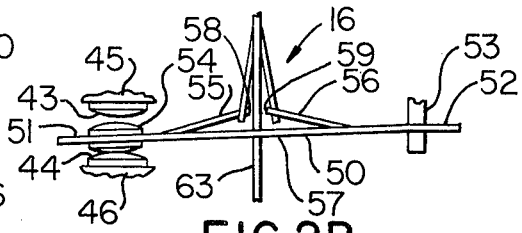
FIG. 2B is a view similar to FIG. 2A and illustrates the electrical switch in its other operating position.

When the actuator 63 is moved upwardly from the position illustrated in FIG. 2A to the position illustrated schematically in FIG. 2B so as to cause the tongues 55 and 56 of the blade 50 to move over center above the tension members 57, the blade 50 snaps the end 51 downwardly to hold the contact 54 thereof into electrical contact with the lower fixed contact 44 so that the electrical circuit is now completed from the terminal arm 53 to the terminal arm 46 through the conductive blade 50.

The details of the electrical switch 16 and the method of making the same are disclosed and claimed in another concurrently filed patent application, Ser. No. 428,876, filed Dec. 27, 1973, now Pat. No. 3,983,351, whereby reference can be made to such copending patent application if further details of the electrical switch 16 and method of making the same are desired.

The motion transmitting means 25 includes an insulated member 72 disposed in sliding relation in an opening 73 passing through an end wall 74 of the housing part 12 of the housing means 11 and has guides 75 thereon received in guide slots 76 in the housing part 12 which guide sliding axial movement of the part 72 relative to the housing means 11 while preventing the same from rotating relative thereto and from falling out of the opening 73 as the guide slots 76 terminate short of the lower end 77 of a tubular part 78 of the end wall 74 that has the opening 73 passing therethrough.

The sliding part 72 has a bore 79 interrupting the lower end 80 thereof and threadedly receives a self-tapping or thread making externally threaded screw member 81 having an enlarged rectangularly shaped head 82 at the lower end thereof and provided with a convex lower surface 83 that is adapted to bear against the flat upper surface 84 of the plate member 42.

The adjusting ring 19 of the housing 17 is held in position in the casing 18 by a suitable inward staking 85 of the casing 18 above and below the same as illustrated in FIGS. 1 and 2 and has an inner frustoconical portion 86 telescopically disposed about the tubular part 78 of the upper housing means 11 and carrying a tubular member 87 that is forced against the portion 85 of the ring 19 to prevent rotaton therebetween and which terminates with a rectangular portion 88 at the lower end thereof to receive the rectangular head 82 of the threaded member 81 and thereby prevent rotation thereof relative to member 87 while permitting axial movement of the head 82 relative thereto for a purpose hereinafter described.

A range spring 89 is disposed in the chamber 23 of the lower housing means 17 and has one end 90 bearing against the adjustment ring 19 and the other end 91 bearing against the plate member 42 to tend to urge the plate member 42 downwardly and, thus, urge the movable diaphragm member 26 downwardly against the fixed diaphragm member 27 in opposition to the force of any fluid pressure in the chamber 30 of the power element 24 whereby a certain pressure is required in the chamber 30 to cause the movable wall 26 to move upwardly away form the fixed wall 27 and thereby move the motion transmitting means 25 upwardly in opposition to the force of the range spring 89, as well as the force of the switch spring 69 as will be apparent hereinafter.

Because the plate member 42 has the ball 41 on the lower side thereof and the convex end surface 83 of the screw head 82 contacts the upper flat side thereof, the plate member 42 is, in effect, universally mounted between the diaphragm button 38 and the adjustment screw 81 to compensate for any misalignment of the motion transmitting arrangement 25 as well as uneven force of the range spring 89 as the plate member 42 can float in a universal manner.

The insulated part 72 of the motion transmitting means 25 has an upper convex surface 92 bearing against the lower end 65 of the C-shaped actuator 63 whereby the switch blade 50 is adapted to be actuated by the motion transmitting means 25 in a manner now to be described.

As long as the motion transmitting means 25 is in the position illustrated in FIGS. 2 and 2A, an electrical circuit is provided between the protruding terminal portions 53' and 45' of the respective terminal arms 53 and 45 as the switch blade 50 is maintained with its contact means 54 in contact with the upper fixed contact 43 as illustrated.

However, as fluid pressure builds up in the chamber 30 of the power element 24, such pressure differential across the movable wall 26 of the power element 24 continues to increase and when the same overcomes the force of the range spring 89, as well as the additional force of the compression spring 69 of the switch 16, the movable wall 26 moves upwardly and, through the contact button 38, ball 41, plate member 42, threaded member 81 and insulated member 72, acts against the lower end 65 of the C-shaped actuator 63 to move the same upwardly from the position illustrated in FIG. 2 until the tongues 55 and 56 snap over center and cause the end 51 of the blade 50 to snap downwardly from the position illustrated in FIG. 2A to the position illustrated in FIG. 2B and place the electrical contact 54 into contact with the lower contact 44. Thus, the electrical circuit is now created between the protruding terminal parts 53' and 46' of the respective terminal arms 53 and 46. This condition of the switch construction 10 will continue to exist as illustrated in FIG. 2B until the fluid pressure directed to the chamber 30 of the power element decreases to a condition which will permit the movable wall 26 to be moved downwardly by the force of the range spring 89 and upper compression spring 69 and cause the tongues 55 and 56 of the snap blade 50 to snap downwardly over center from the position illustrated in FIG. 2B to the position illustrated in FIG. 2A and thereby cause the snap blade 50 to snap upwardly as illustrated in FIG. 2A.

Thus, it can be seen that the switch construction 10 is adapted to switch the common terminal part 53' between the terminal parts 45' and 46' depending upon the pressure condition in the chamber 30 of the element 24 as determined by the preset force of the compression spring 89 acting on the plate member 42.

Upward movement of the diaphragm member 26 of the power element is limited by the plate member 42 engaging against the end 88 of the tubular member 87 while downward movement of the diaphragm member 26 is limited, in effect, by the shoulder 37 of its fitting 21.

The method of making the switch construction 10 will now be described.

If is is desired to form the switch construction 10 so that the same will have the contact means 54 of the blade 50 open away from the lower fixed contact 44 upon a decrease in pressure in the chamber 30 of the power element 24 and that a certain cut in pressure value and a certain cut out pressure value are to be utilized, the switch housing means 11 is preassembled by itself so that the threaded member 81 extends out of the lower end 77 of the tubular member 78 whereby the housing means 11 is a self-contained unit by itself.

However, the housing means 17 is assembled by first having the power element 24 disposed therein in the position illustrated in FIG. 2 and the plate member 42 is then disposed on top of the same. The range spring 89 is then inserted through the open end 20 of the casing 18 so that the lower end 91 thereof will abut against the plate 42. Thereafter, the adjustment ring 19 is placed down through the open end 20 of the casing 18 until the same abuts against the upper end 90 of the spring 89.

Because the adjustment ring 19 is not fixed in the casing 18, the power element 24 has the movable wall 26 disposed away from the fixed wall 27. Downward force is applied to the adjustment ring 19 forcing the same downwardly and, thus, the compression spring 89, plate 42, diaphragm button 38 and movable wall 26, until the movable wall 26 is spaced a certain distance from the lower stop or shoulder 37 of the fitting 21, such as approximately 0.010 of an inch therefrom. At this time, fluid pressure is directed to the power element 24 through the fitting 21 at the exact value that is desired for having the movable contact 54 initially move away from the lower fixed contact 44 and such cut-out pressure value is maintained in the chamber 30 of the power element 24. At this time, the casing 18 is staked at the side wall thereof to form the previously described staking portions 85 of the casing 18 on each side of the adjustment ring 19 at various positions about the periphery of the casing 18 to hold the adjustment ring 19 at the previously described adjusted position thereof.

The switch housing 11 is then placed into the open end 20 of the casing 18 with the square or rectangular head 82 of the adjusting screw memer 81 fitting into the rectangular part 88 of the tubular member 87, the insulating member 72 and the adjustment screw 81 being originally positioned relative to one another so that when the outer annular surface of the end wall 74 of the housing means 11 abuts against the secured adjustment member 19 in the manner illustrated in FIG. 2, the tongues 55 and 56 of the snap blade 50 have been moved upwardly to the position illustrated in FIG. 2B so that the contact 54 of the blade 50 is in contact with the lower fixed contact 44 as illustrated in FIG. 2B.

With the switch housing 11 assembled to the power element housing 17 in the above manner, the desired cut-out pressure for opening the contact 54 away from the lower fixed contact 44 is maintained in the chamber 30 of the power element 24 and the entire switch housing 11 is rotated relative to the lower housing 17 in a direction which will cause the insulating member 72 to rotate relative to the threaded screw 81 as its head 82 is captured by the rectangular part 88 of the tubular member 87 so that the screw 81 cannot rotate with the rotating member 72 whereby the insulated member 72 is threaded onto the screw 81 in an increasing amount and, thus, moves downwardly in FIG. 2 causing the actuator 63 under the force of the compression spring 69 to move downwardly therewith and such movement continues to take place until the switch 16 trips by having the blade 50 snap the contact 54 away from the lower fixed contact 44.

At this time, no further rotation of the housing 11 relative to the housing 17 takes place but the desired cut in pressure is then applid in the chamber 30 of the power element 24 and then the differential screw 47 is turned down to move the upper fixed contact 43 downwardly with the movable contact 54 remaining in contact therewith until the end 51 of the blade 50 has been moved down sufficiently to cause the blade 50 to now snap the movable contact 54 away from the upper contact 43 and into contact with the lower fixed contact 44.

At this time, the housing 17 is staked to the housing 11 by having upper portions 100 of the casing 18 depressed into cooperating grooves 101 in the housing 11 whereby the housing 11 and 17 are secured together in the desired assembled relation and no further relative rotation of the housings 11 and 17 can take place.

Further, the contact 54 of the switch blade 50 will now always be moved away from the fixed contact 44 whenever the pressure in the chamber 30 of the power element falls below the desired cut-out pressure previously described and will always be moved into contact with the lower contact 44 whenever the pressure in the chamber 30 reaches or exceeds the previously described cut in pressure, the switch construction 10 operating in the manner previously described to cause the blade 50 to snap between the positions illustrated in FIG. 2A and FIG. 2B.

Therefore, it can be seen that this invention not only provide a fluid operated electrical switch construction having improved motion transmitting adjusting means, but also this invention provides an improved method for making such a fluid operated electrical switch construction or the like.

While the form and method of this invention now preferred have been described and illustrated as required by the Patent Statute, it is to be understood that other forms and methods may be utilized and still come within the scope of the appended claims.

What is claimed is:

1. A method of making a fluid operated electrical switch construction comprising the steps of providing a first housing having an electrical switch therein, providing a second housing having an expandible and contractible element therein, providing a motion transmitting means that has a length adjustment means therein for adjusting the length of said motion transmitting means, assembling said housing together so that said motion transmitting means is disposed in said housings between said element and said switch to transmit movement of said element to said switch to operate the same, adjusting the length of said length adjustment means of said motion transmitting means solely by causing relative movement between said housings while said housings are assembled together but before the same are secured together, and, thereafter securing said housing together so that said length adjusting means will be at desired adjusted condition thereof.

2. A method of making a fluid operated electrical switch construction as set forth in claim 1 wherein said step of causing relative movement between said housings for adjustment of said adjustment means comprises the step of causing rotational movement therebetween.

3. A method of making a fluid operated electrical switch construction as set forth in claim 2 and including the step of forming said adjustment means from a pair of cooperating threaded members which thread axially of each other as said rotational movement of said housing takes place.

4. A method of making a fluid operated electrical switch construction as set forth in claim 3 wherein one of said housings carries said threaded members and including the step of forming the other of said housings with means for holding one of said members to prevent the same from turning relative said other housing when said housings are assembled together.

5. A method of making a fluid operated electrical switch construction as set forth in claim 4 wherein said step of forming said holding means of said other housing also causes said holding means to act as a stop means for limiting expanding movement of said element.

6. A method of making a fluid operated electrical switch construction as set forth in claim 4 and including the steps of forming said one threaded member with an end provided with a convex surface, and disposing a plate member in said second housing so that said plate member has one side thereof disposed against said convex surface and the other side thereof operatively associated with said element whereby said plate forms part of said motion transmitting means and said second housing comprises said other housing.

7. A method of making a fluid operated electrical switch construction as set forth in claim 6 and including the step of disposing a ball on said other side of said plate member so that said ball is operatively associated with said element.

8. A method of making a fluid operated electrical switch construction as set forth in claim 6 and including the step of disposing a range spring in said second housing so that said spring acts against said one side of said plate member.

9. A method of making a fluid operated electrical switch construction as set forth in claim 1 and including the step of forming part of said motion transmitting means with a plate member that is substantially universally mounted by said motion transmitting means whereby axial alignment of said motion transmitting means is maintained between said element and said switch by said plate element.

10. A method of making a fluid operated electrical switch construction as set forth in claim 9 and including the steps of disposing said plate member in said second housing, and disposing a range spring in said second housing so as to act against said plate in a direction to tend to collapse said element.

11. A method of making a fluid operated electrical switch construction comprising the steps of providing a first housing having an electrical switch therein, providing a second housing having an expandible and contractible element therein, providing a motion transmitting means that has a length adjustment means therein for adjusting the length of said motion transmitting means, assembling said housings together so that said housings are in a certain telescoped relation and so that said motion transmitting means is disposed in said housings between said element and said switch to transmit movement of said element to said switch to operate the same, adjusting the length of said length adjustment means of said motion transmitting means solely by causing relative rotational movement between said housings while said housings are assembled together in said certain telescoped relation but before the same are secured together, and, thereafter securing said housings together in said certain telescoped relation so that said length adjusting means will be at desired adjusted condition thereof.

* * * * *